US009518774B2

(12) United States Patent
Miller

(10) Patent No.: US 9,518,774 B2
(45) Date of Patent: Dec. 13, 2016

(54) ICE MAKING APPLIANCE

(71) Applicant: General Electric Company, Schenectady, NY (US)

(72) Inventor: Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 292 days.

(21) Appl. No.: 14/279,686

(22) Filed: May 16, 2014

(65) Prior Publication Data

US 2015/0330695 A1 Nov. 19, 2015

(51) Int. Cl.

| | |
|---|---|
| ***F25C 5/00*** | (2006.01) |
| ***F25C 5/18*** | (2006.01) |
| ***F25D 17/06*** | (2006.01) |
| *F25D 17/04* | (2006.01) |
| *F25D 21/14* | (2006.01) |

(52) U.S. Cl.

CPC ..... *F25C 5/182* (2013.01); *F25D 17/06* (2013.01); *F25C 2400/08* (2013.01); *F25C 2400/10* (2013.01); *F25D 17/045* (2013.01); *F25D 21/14* (2013.01); *F25D 2317/061* (2013.01)

(58) Field of Classification Search

CPC .... F25C 2400/08; F25D 17/045; F25D 17/065

See application file for complete search history.

(56) References Cited

U.S. PATENT DOCUMENTS

| | | | | |
|---|---|---|---|---|
| 9,115,922 | B2 * | 8/2015 | Boarman | F25C 5/005 |
| 2005/0061018 | A1 * | 3/2005 | Kim | F25C 5/005 62/344 |
| 2009/0165492 | A1 * | 7/2009 | Wilson | F25C 1/10 62/344 |
| 2010/0050681 | A1 | 3/2010 | Ryu et al. | |
| 2012/0111048 | A1 | 5/2012 | Kim et al. | |
| 2012/0324915 | A1 * | 12/2012 | Bortoletto | F25C 1/12 62/66 |

FOREIGN PATENT DOCUMENTS

| | | |
|---|---|---|
| KR | 2013/0063729 | 6/2013 |

* cited by examiner

*Primary Examiner* — Cassey D Bauer

(74) *Attorney, Agent, or Firm* — Dority & Manning, P.A.

(57) ABSTRACT

An ice making appliance is provided. The ice making appliance includes a first ice maker and a second ice maker. The first and second ice makers generate different types of ice. The ice making appliance also includes supply ducts for receiving chilled air from an evaporator and directing the chilled air to the first and second ice makers.

15 Claims, 8 Drawing Sheets

ICE MAKING APPLIANCE

FIELD OF THE INVENTION

The present subject matter relates generally to ice making appliances.

BACKGROUND OF THE INVENTION

Ice making appliances generally include a single ice maker that is configured to generate a specific type of ice. For example, certain ice makers generate ice cubes while other ice makers generate flaked or shaved ice. Consumers generally prefer a particular type of ice. For example, certain consumers prefer the longevity of ice cubes while other consumers prefer the texture of flaked or shaved ice. Thus, a consumer generally selects an ice making appliances for the specific type of ice that the appliance's ice maker produces with the understanding that only one type of ice will be produced.

Ice makers within ice making appliance are also generally directly cooled with refrigerant from a sealed system of the ice making appliance. Thus, such ice makers are configured to receive refrigerant and facilitate heat transfer between liquid water in the ice maker and the refrigerant in order to generate ice. Plumbing the sealed system to direct refrigerant to the ice maker can be difficult and costly. In particular, complex sealed systems can be difficult and expensive to produce.

Accordingly, an ice making appliance with features for generating or producing multiple types of ice would be useful. In particular, an ice making appliance with features for generating or producing multiple types of ice that does not require directly cooling ice makers of the ice making appliance with refrigerant would be useful.

BRIEF DESCRIPTION OF THE INVENTION

The present subject matter provides an ice making appliance. The ice making appliance includes a first ice maker and a second ice maker. The first and second ice makers generate different types of ice. The ice making appliance also includes supply ducts for receiving chilled air from an evaporator and directing the chilled air to the first and second ice makers. Additional aspects and advantages of the invention will be set forth in part in the following description, or may be apparent from the description, or may be learned through practice of the invention.

In a first exemplary embodiment, an ice making appliance is provided. The ice making appliance includes a cabinet. A first ice maker is positioned within the cabinet and is configured for producing a first type of ice. A second ice maker is positioned within the cabinet and is configured for producing a second type of ice. The first and second types of ice are different. A sealed system includes an evaporator. The evaporator is configured for generating chilled air during operation of the sealed system. A first supply duct has an inlet positioned for receiving the chilled air from the evaporator. The first supply duct extends from the inlet of the first supply duct to the first ice maker in order to direct the chilled air from the evaporator to the first ice maker. A second supply duct has an inlet positioned for receiving the chilled air from the evaporator. The second supply duct extends from the inlet of the second supply duct to the second ice maker in order to direct the chilled air from the evaporator to the second ice maker.

In a second exemplary embodiment, an ice making appliance is provided. The ice making appliance includes a cabinet. The ice making appliance also includes means for producing a first type of ice with chilled air and means for producing a second type of ice with chilled air. The first and second types of ice are different. A sealed system includes an evaporator. The evaporator is configured for generating the chilled air during operation of the sealed system.

In a third exemplary embodiment, a method for operating an ice making appliance is provided. The method includes generating chilled air at an evaporator of a sealed system of the ice making appliance, directing the chilled air from the evaporator to a first ice maker of the ice making appliance and a second ice maker of the ice making appliance, and forming a first type of ice in the first ice maker and a second type of ice in the second ice maker during said step of directing. The first and second types of ice are different. The method also includes storing the first type of ice in a first storage bin of the ice making appliance and the second type of ice in a second storage bin of the ice making appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
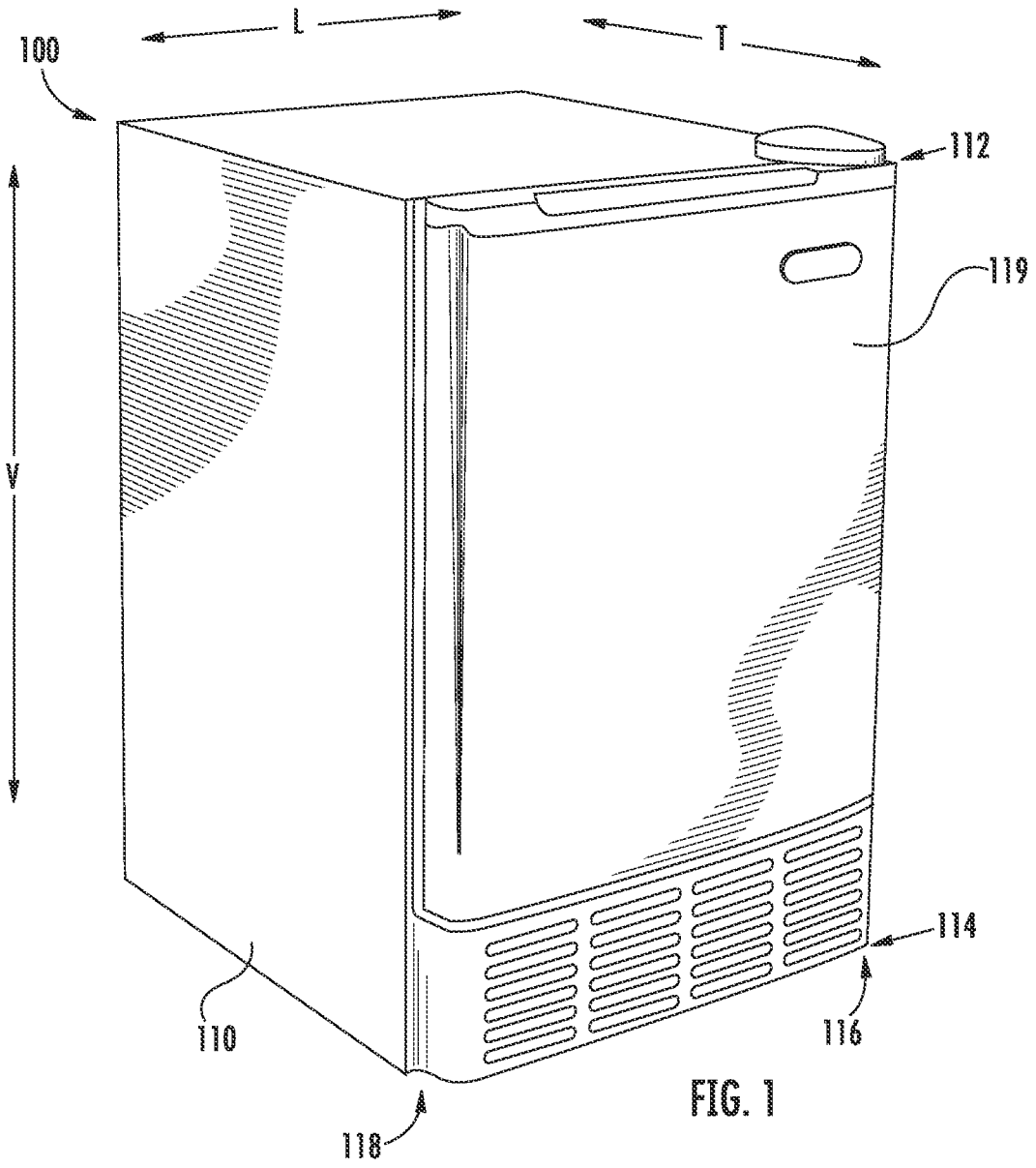
FIG. 1 provides a perspective view of an ice making appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an ice making appliance 100 according to an exemplary embodiment of the present subject matter. As discussed in greater detail below, ice making appliance 100 includes features for generating or producing multiple types of ice. Thus, a user of ice making appliance 100 may select and consume a preferred type of ice from amongst the multiple types of ice stored within ice making appliance 100. As may be seen in FIG. 1, ice making appliance 100 defines a vertical direction V, a lateral direction L and a transverse direction T. The vertical direction V, lateral direction L and transverse direction T are mutually perpendicular and form an orthogonal direction system.

Ice making appliance 100 includes a cabinet 110. Cabinet 110 may be insulated in order to limit heat transfer between an interior volume 111 (FIG. 2) of cabinet 110 and ambient atmosphere. Cabinet 110 extends between a top portion 112 and a bottom portion 114, e.g., along the vertical direction V. Thus, top and bottom portions 112, 114 of cabinet 110 are spaced apart from each other, e.g., along the vertical direction V. Cabinet 110 also extends between a first side portion 116 and a second side portion 118, e.g., along the lateral direction L. Thus, first and second side portions 116, 118 of cabinet 110 are spaced apart from each other, e.g., along the lateral direction L. A door 119 is mounted to cabinet 110 at a front portion of cabinet 110. Door 119 permits selective access to interior volume 111 of cabinet 110.

Figure 2:
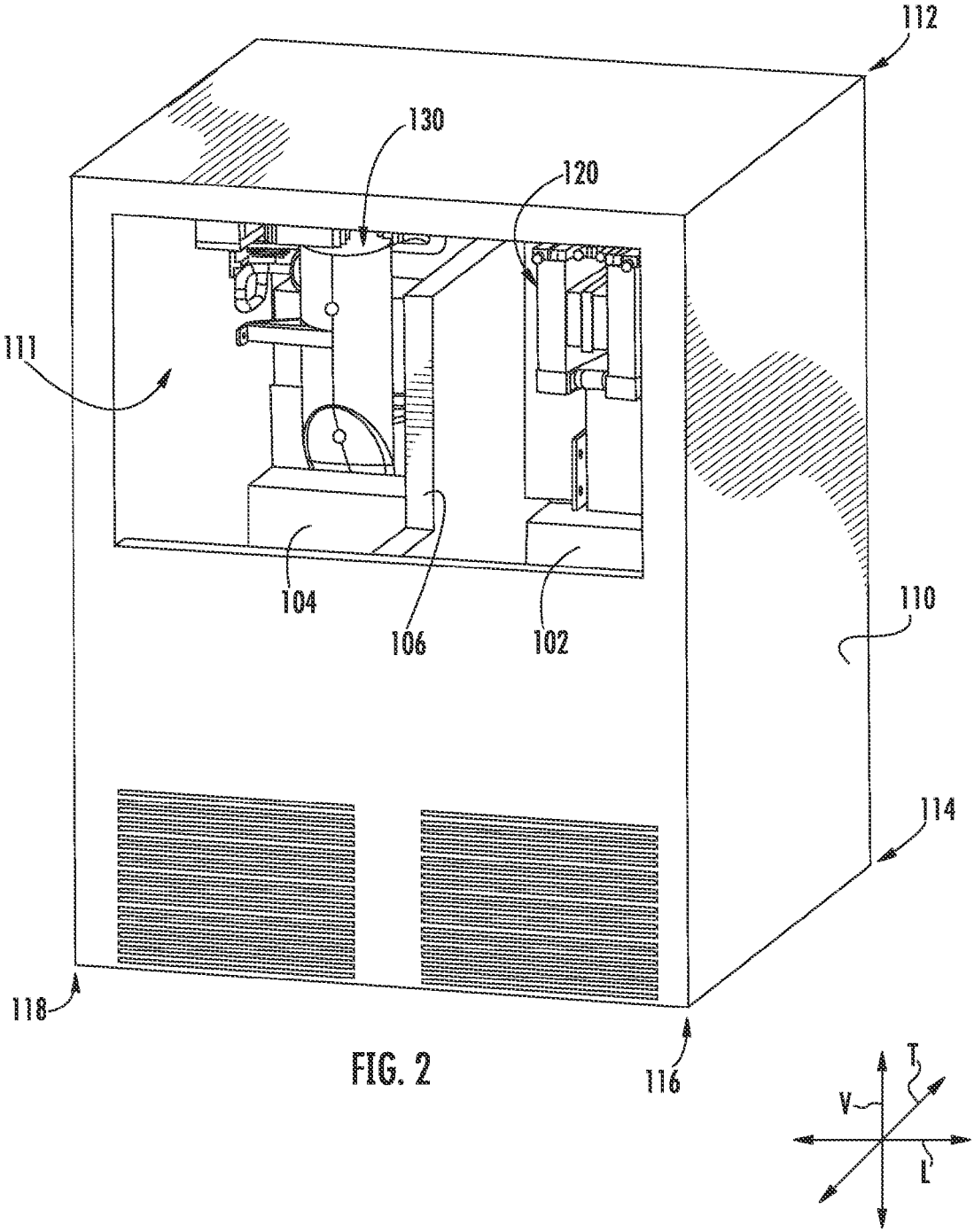
FIGS. 2 and 3 provide perspective views of the exemplary ice making appliance of FIG. 1 with a door of the exemplary ice making appliance removed to reveal certain components of the exemplary ice making appliance.
Figure 3:
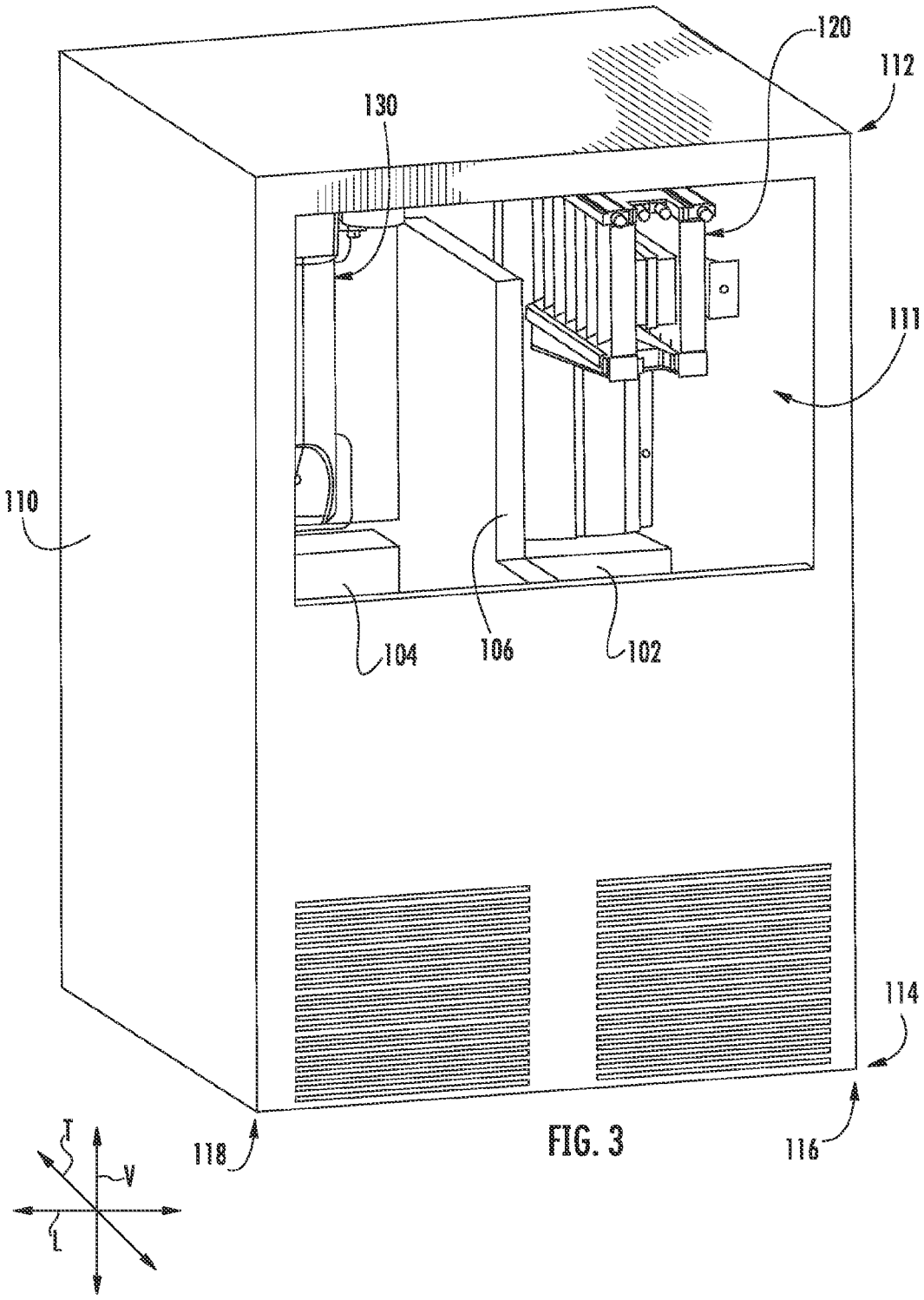

FIGS. 2 and 3 provide perspective views of ice making appliance 100. In FIGS. 2 and 3, door 119 is removed from cabinet 110 in order to reveal interior volume 111 of cabinet 110 and certain components of ice making appliance 100 positioned therein. As may be seen in FIGS. 2 and 3, ice making appliance 100 includes a first ice maker 120 and a second ice maker 130 disposed within interior volume 111 of cabinet 110, e.g., at top portion 112 of cabinet 110. First ice maker 120 is configured for producing a first type of ice. Conversely, second ice maker 130 is configured for producing a second type of ice. The first and second types of ice are different.

The first and second types of ice may be any suitable types of ice. For example, the first type of ice may be clear ice cubes while the second ice type may be ice nuggets. Thus, first ice maker 120 may be a clear cube ice maker, such as the ice maker described in U.S. Pat. No. 5,212,957 entitled "Refrigerator/Water Purifier" which is incorporated by reference herein in its entirety, and second ice maker 130 may be a nugget-style ice maker, such as the icemaker system described in U.S. Patent Publication No. 2013/0276472 entitled "Auger-Driven Icemaker System for Refrigerator" which is incorporated by reference herein in its entirety. As another example, first ice maker 120 may be a standard crescent ice maker, and second ice maker 130 may be a clear cube ice maker. It should be understood that first and second ice makers 120, 130 may be any suitable combination of air cooled ice makers with first and second ice makers 120, 130 configured for making or generating different types of ice in alternative exemplary embodiments.

By providing first and second ice makers 120, 130, a user of ice making appliance 100 may select between the first and second types of ice. As an example, a user who prefers crescent ice cubes may utilize or consume ice from first ice maker 120, and a user who prefers ice nuggets may utilize or consume ice from second ice maker 130.

Ice making assembly 100 also includes a first storage bin 102 and a second storage bin 104. First storage bin 102 is disposed within cabinet 110, e.g., at or adjacent first side portion 116 of cabinet 110. In addition, first storage bin 102 may be positioned, e.g., directly, below first ice maker 120 along the vertical direction V. Thus, first storage bin 102 is positioned for receiving ice from first ice maker 120 and is configured for storing such ice therein. Second storage bin 104 is disposed within cabinet 110, e.g., at or adjacent second side portion 118 of cabinet 110. In addition, second storage bin 104 may be positioned, e.g., directly, below second ice maker 130 along the vertical direction V. Thus, second storage bin 104 is positioned for receiving ice from second ice maker 130 and is configured for storing such ice therein. A divider 106 may be disposed or positioned between first and second storage bins 102, 104.

Figure 4:
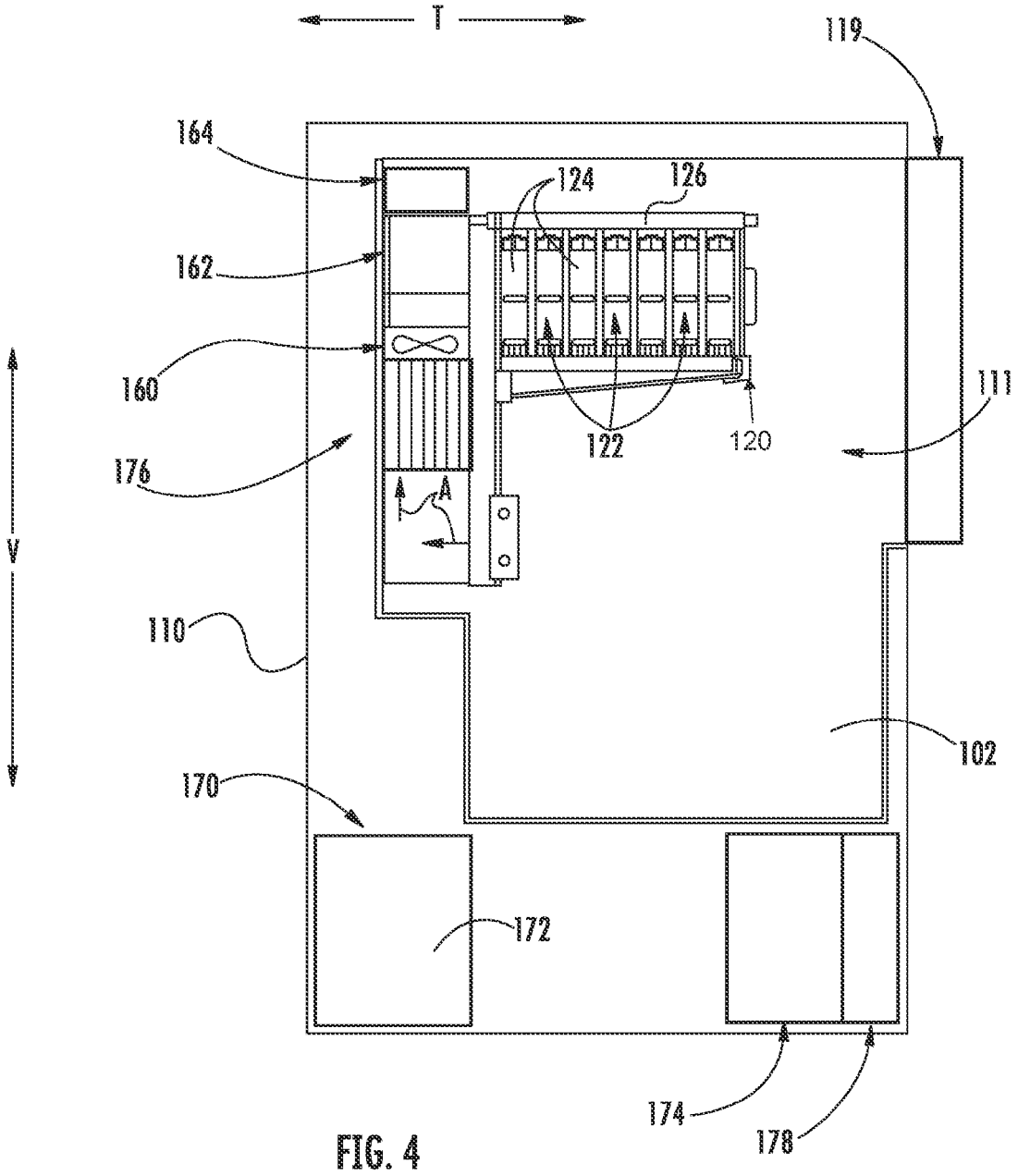
FIG. 4 provides a side section view of the exemplary ice making appliance of FIG. 1 and a first ice maker of the exemplary ice making appliance.

FIG. 4 provides a side section view of ice making appliance 100. As may be seen in FIG. 4, first ice maker 120 includes a plurality of channels 122, a plate 124 and conduits 126. Plate 124 is positioned within channels 122, and the liquid water from conduits 126 may flow across plate 124. As discussed in greater detail below, plate 124 is cooled by chilled air passing or flowing across a back surface of plate 124. Thus, the liquid water flowing through channels 122 may freeze on plate 124, e.g., in order to form crescent ice cubes on plate 124 within channels 122.

To cool plate 124, ice making assembly 100 includes a sealed system 170. Sealed system 170 includes components for executing a known vapor compression cycle for cooling air. The components include a compressor 172, a condenser 174, an expansion device (not shown), and an evaporator 176 connected in series and charged with a refrigerant. As will be understood by those skilled in the art, sealed system 170 may include additional components, e.g., at least one additional evaporator, compressor, expansion device, and/or condenser. Thus, sealed system 170 is provided by way of example only. It is within the scope of the present subject matter for other configurations of a sealed system to be used as well.

Within sealed system 170, refrigerant flows into compressor 172, which operates to increase the pressure of the refrigerant. This compression of the refrigerant raises its temperature, which is lowered by passing the refrigerant through condenser 174. Within condenser 174, heat exchange with ambient air takes place so as to cool the refrigerant. A fan 178 may operate to pull air across condenser 174 so as to provide forced convection for a more rapid and efficient heat exchange between the refrigerant within condenser 174 and the ambient air.

The expansion device (e.g., a valve, capillary tube, or other restriction device) receives refrigerant from condenser 174. From the expansion device, the refrigerant enters evaporator 176. Upon exiting the expansion device and entering evaporator 176, the refrigerant drops in pressure. Due to the pressure drop and/or phase change of the refrigerant, evaporator 176 is cool, e.g., relative to ambient air and/or liquid water. As such, cooled air is produced and refrigerates various components of ice making appliance 100, such as plate 124 of first ice maker 120. Thus, evaporator 176 is a type of heat exchanger which transfers heat from air passing over evaporator 176 to refrigerant flowing through evaporator 176.

Figure 5:
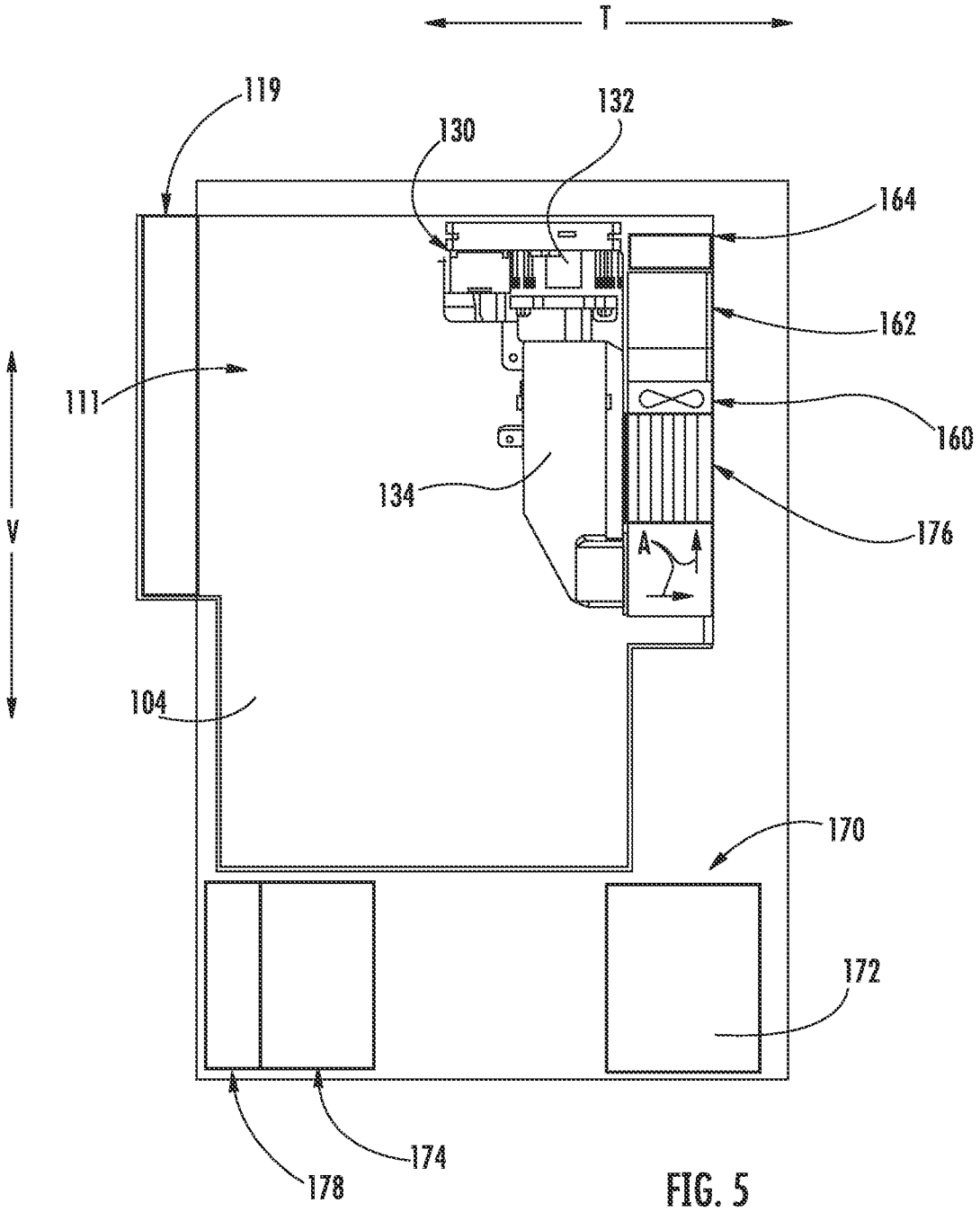
FIG. 5 provides a side section view of the exemplary ice making appliance of FIG. 1 and a second ice maker of the exemplary ice making appliance.

FIG. 5 provides a side section view of ice making appliance 100. As may be seen in FIG. 5, second ice maker 130 includes a motor 132 and a casing 134. Motor 132 is coupled to an auger (not shown) within casing 134. Chilled air from evaporator 176 is directed to second ice maker 130 through casing 134 in order to generate ice. During operation of motor 132, the auger scrapes the ice and pushes the ice through an extruder in order to form ice nuggets.

Figure 6:
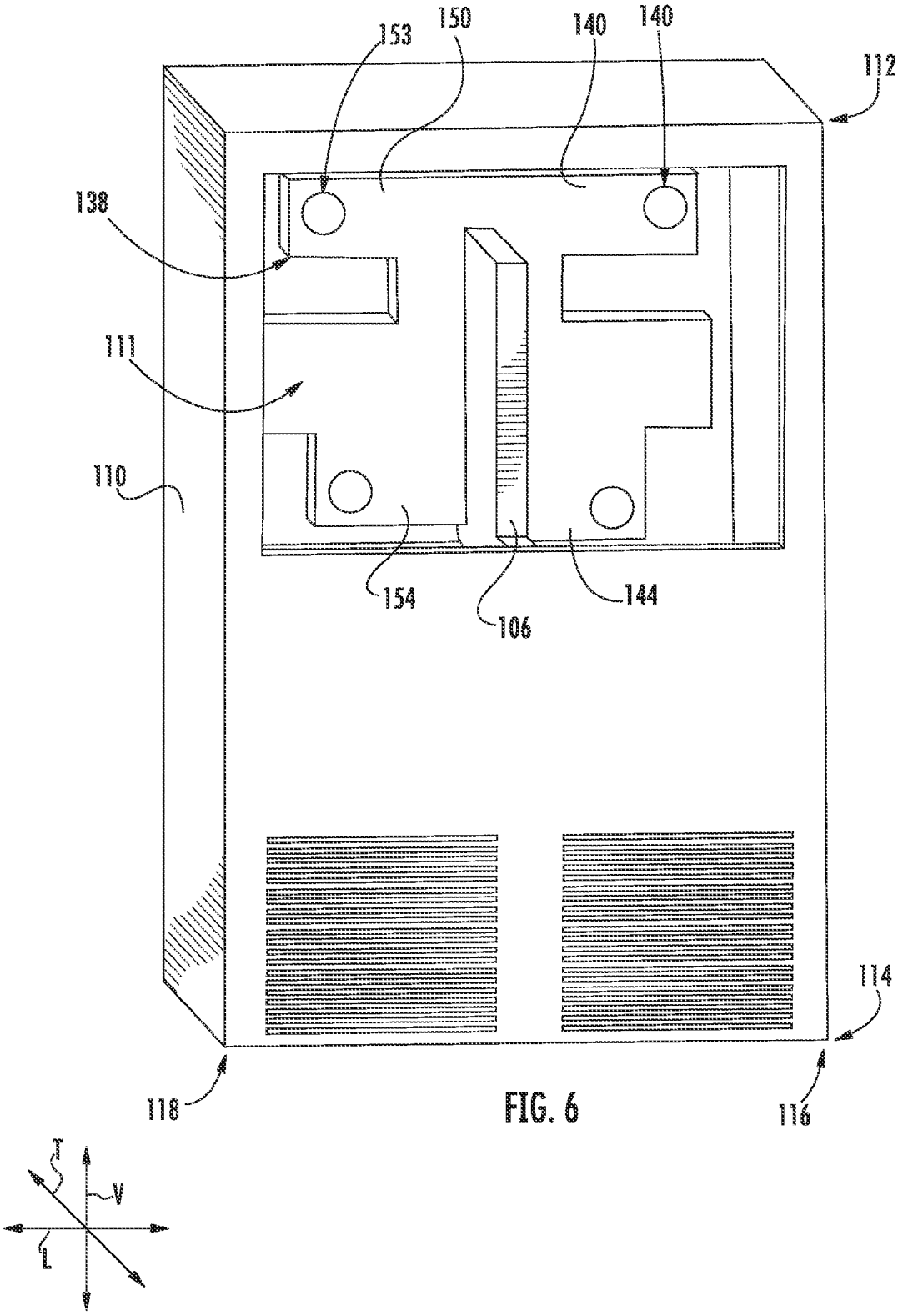
FIG. 6 provide perspective views of the exemplary ice making appliance of FIG. 1 with the door and a first and second ice makers of the exemplary ice making appliance removed to reveal certain components of the exemplary ice making appliance.
Figure 7:
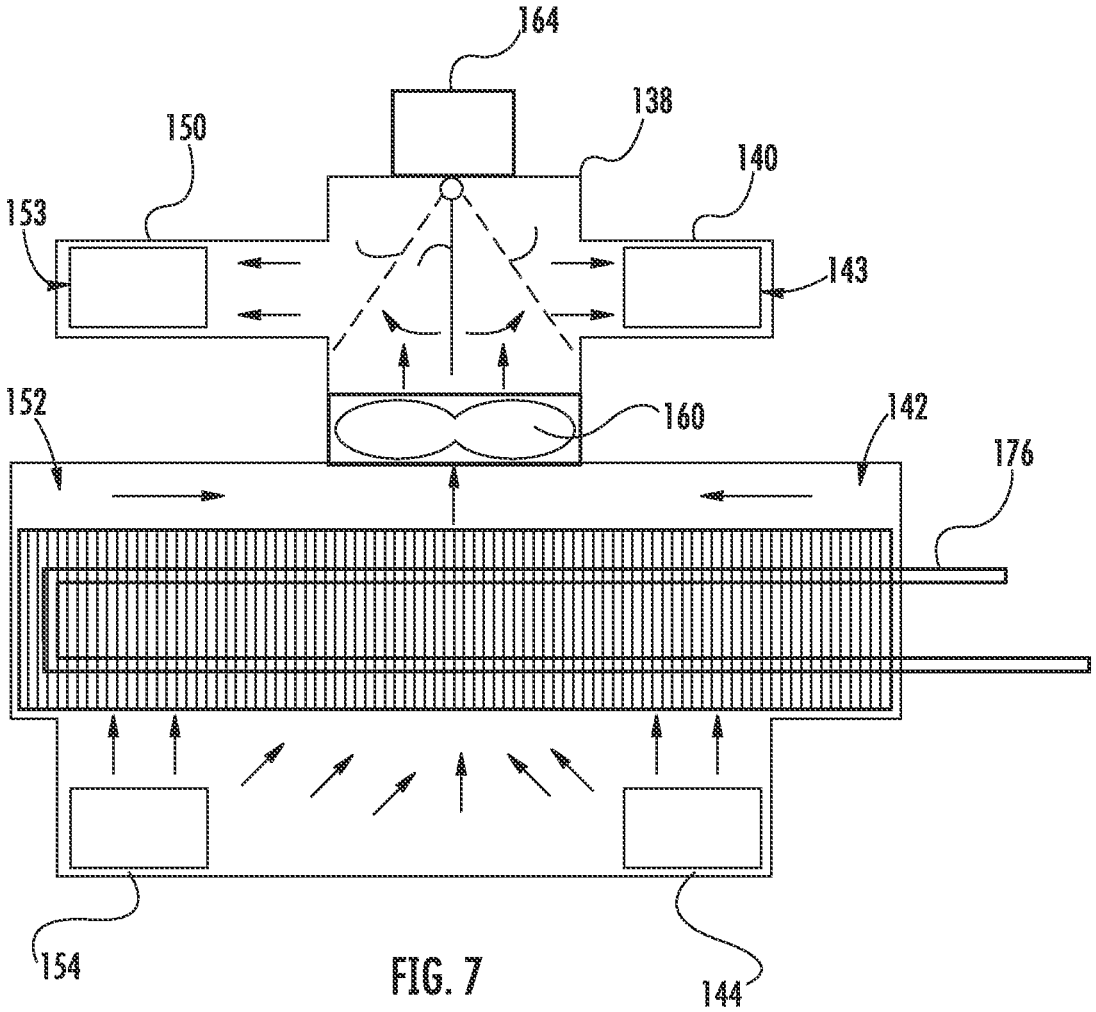
FIG. 7 provides a schematic view of certain components of the exemplary ice making appliance of FIG. 1.

FIG. 6 provide perspective views of ice making appliance 100 with first and second ice makers 120, 130 removed to reveal certain components of ice making appliance 100. FIG. 7 provides a schematic view of certain components of ice making appliance 100. As may be seen in FIGS. 6 and 7, ice making appliance 100 includes a duct network 138. Duct network 138 is configured for directing chilled air from evaporator 176 to first and second ice makers 120, 130 in order to permit formation of ice with first and second ice makers 120, 130. As an example, duct network 138 may be a molded plastic component mounted to cabinet 110 within interior volume 111 of cabinet 110. In particular, duct network 138 may be mounted to a back wall of cabinet 110 within interior volume 111 of cabinet 110.

Duct network 138 includes a first supply duct 140 and a first return duct 144. First supply duct 140 extends between evaporator 176 and first ice maker 120 in order to direct chilled air from evaporator 176 to first ice maker 120. In particular, an inlet 142 of first supply duct 140 is positioned at or adjacent evaporator 176 in order to receive chilled air from evaporator 176, and an outlet 143 of first supply duct 140 is positioned at or adjacent first ice maker 120 in order to direct chilled air from evaporator 176 into or across first ice maker 120. First return duct 144 extends between first ice maker 120 and evaporator 176 in order to direct air from first ice maker 120 to evaporator 176. Thus, after cooling first ice maker 120, air from first supply duct 140 may be recirculated to evaporator 176 via first return duct 144.

Duct network 138 also includes a second supply duct 150 and a second return duct 154. Second supply duct 150 extends between evaporator 176 and second ice maker 130 in order to direct chilled air from evaporator 176 to second ice maker 130. In particular, an inlet 152 of second supply duct 150 is positioned at or adjacent evaporator 176 in order to receive chilled air from evaporator 176, and an outlet 153 of second supply duct 150 is positioned at or adjacent second ice maker 130 in order to direct chilled air from evaporator 176 into or across second ice maker 130. Second return duct 154 extends between second ice maker 130 and evaporator 176 in order to direct air from second ice maker 130 to evaporator 176. Thus, after cooling second ice maker 130, air from second supply duct 150 may be recirculated to evaporator 176 via second return duct 154.

Duct network 138 permits operation of first and second ice makers 120, 130 with chilled air. Thus, ice making appliance 100 need not include expensive and/or complex plumbing of refrigerant to first and second ice makers 120, 130.

Turning to FIG. 7, ice making appliance 100 includes a fan or air handler 160. Air handler 160 is disposed at or within duct network 138. Air handler 160 is operable to urge the chilled air from evaporator 176 into and/or through first and second supply ducts 140, 150. Thus, air handler 160 may actively force or circulate chilled air from evaporator 176 through duct network 138 in order to cool first ice maker 120 and/or second ice maker 130.

Ice making appliance 100 also includes a damper 162. Damper 162 is disposed at or within duct network 138. In order to regulate air flow through duct network 138, damper 162 is selectively adjustable, e.g., with a motor or similar actuator 164, between a first position, a second position and a third position. In the first position (shown with dashed line P1), damper 162 obstructs first supply duct 140 such that the flow of air from evaporator 176 to first ice maker 120 is limited or prevented. In the second position (shown with dashed line P2), damper 162 obstructs second supply duct 150 such that the flow of air from evaporator 176 to second ice maker 130 is limited or prevented. In the third position (shown in FIG. 7), damper 162 obstructs neither the first supply duct 140 nor the second supply duct 150 such that such that the flow of air from evaporator 176 to first and second ice makers 120, 130 is not limited or prevented by damper 162. By adjusting damper 162 between the first, second and third positions, chilled air from evaporator 176 may be directed to first ice maker 120, second ice maker 130 or both.

Whether damper 162 is in the first, second or third positions, air handler 160 may be operated such that air flow rate through first and second supply ducts 140, 150 is substantially constant. For example, the air flow rate through first supply duct 140 when damper 162 is in the second position may be substantially equal (e.g., within about ten percent) to the air flow rate through first supply duct 140 when damper 162 is in the third position. Similarly, the air flow rate through second supply duct 150 when damper 162 is in the first position may be substantially equal (e.g., within about ten percent) to the air flow rate through second supply duct 150 when damper 162 is in the third position. In order to maintain the air flow rates, the speed of air handler 160 (e.g., an impeller of air handler 162) may be modulated, e.g., with pulse width modulation (PWM). Thus, when damper 162 is in either the first or second positions, the speed of air handler 162 may be less than when air handler 162 is in the third position.

Figure 8:
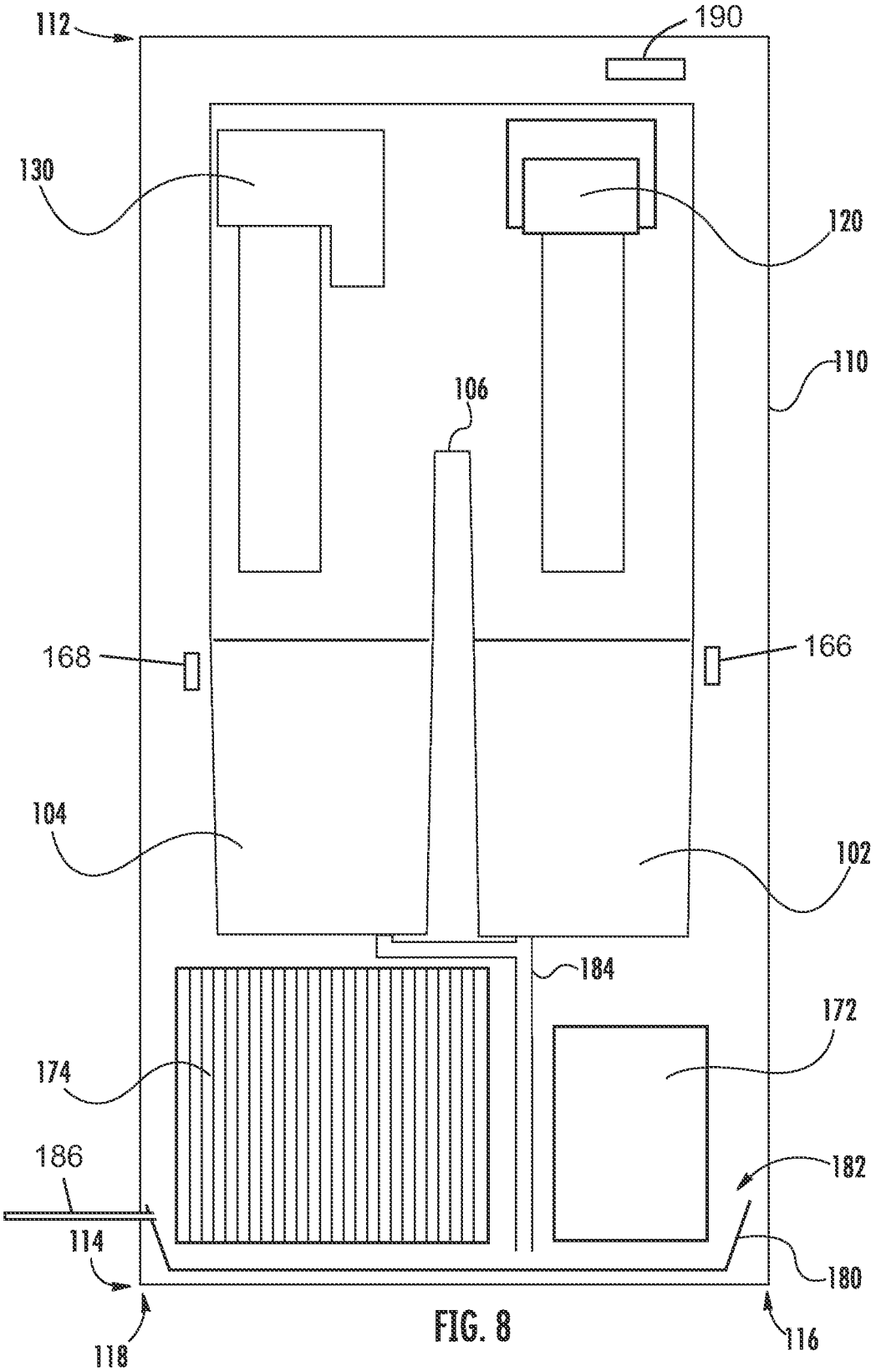
FIG. 8 provides a schematic view of certain components of the exemplary ice making appliance of FIG. 1.

FIG. 8 provides a schematic view of certain components of ice making appliance 100. As may be seen in FIG. 8, ice making appliance 100 includes a first ice level sensor 166 and a second ice level sensor 168. First ice level sensor 166 is positioned adjacent first storage bin 102 and is configured for measuring or determining a volume or height of ice within first storage bin 102. Second ice level sensor 168 is positioned adjacent second storage bin 104 and is configured for measuring or determining a volume or height of ice within second storage bin 104. First and second ice level sensors 166, 168 may be any suitable types of sensors for measuring or determining the volume or height of ice within first and second storage bins 102, 104. For example, first and second ice level sensors 166, 168 may be rake arms, pressure plates, infrared or optical sensors, ultrasonic sensors, or any suitable combination thereof.

Ice making appliance also includes a controller 190 that regulates or operates various components of ice making appliance 100. Controller 190 may include a memory and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Input/output ("I/O") signals may be routed between controller 190 and various operational components of ice making appliance 100. As an example, the various operational components of ice making appliance 100 may be in communication with controller 190 via one or more signal lines or shared communication busses.

During operation of ice making appliance 100, controller 190 may receive signals from first and second ice level sensors 166, 168 corresponding to whether first and second storage bin 102, 104 are full. As an example, when first ice level sensor 166 determines or establishes that first storage bin 102 is full of ice, controller 190 may deactivate first ice maker 120, e.g., by operating actuator 164 of damper 162 and moving damper 162 to the first position. Similarly, when second ice level sensor 168 determines or establishes that second storage bin 104 is full of ice, controller 190 may deactivate second ice maker 130, e.g., by operating actuator 164 of damper 162 and moving damper 162 to the second position. When neither first nor second storage bins 102, 104 are full, controller 190 may operate actuator 164 of damper 162 in order to move damper 162 to the third position. When both first and second storage bins 102, 104 are full, controller 190 may deactivate first and second ice makers 120, 130, e.g., by deactivating air handler 190.

As may be seen in FIG. 8, ice making appliance 100 includes an evaporation pan 180 having an open top 182. Evaporation pan 180 is positioned within cabinet 110 at the bottom portion 114 of cabinet 110. A drain conduit 184 extends between first storage bin 102 (e.g., and/or second storage bin 104) and evaporation pan 180. As discussed above first and second storage bins 102, 104 are positioned for receiving ice from the first and second ice makers 120, 130, respectively. During storage of ice within first and second storage bins 102, 104, the ice may melt. Liquid runoff from the melted ice may flow through drain conduit 184 into evaporation pan 180. Due to the open top 182 of evaporation pan 180, liquid water within evaporation pan 180 is exposed to ambient atmosphere and the liquid water may evaporate. Thus, ice making appliance 100 need not be plumbed to an external drain line in order to dispose of liquid runoff from melted ice. To further assist of facilitate evaporation of liquid water from evaporation pan 180, condenser 174 may be positioned, e.g., directly, above the open top 182 of evaporation pan 180 along the vertical direction V. The relatively high temperature refrigerant flowing through condenser 174 may assist with heating liquid water within evaporation pan 180 and evaporation of the liquid water.

It should be that in certain exemplary embodiments, ice making appliances 100 includes ice makers that generate a large volume of liquid water runoff. Thus, ice making appliance 100 may include a drain line 186 in certain exemplary embodiments. Drain line 186 may connect first storage bin 102, second storage bin 104 or evaporation pan 180 to an external drain in order to direct liquid water runoff out of ice making appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making appliance, comprising:

a cabinet;

a first ice maker positioned within the cabinet and configured for producing a first type of ice;

a second ice maker positioned within the cabinet and configured for producing a second type of ice, the first and second types of ice being different;

a sealed system comprising an evaporator, the evaporator configured for generating chilled air during operation of the sealed system;

a first supply duct having an inlet positioned for receiving the chilled air from the evaporator, the first supply duct extending from the inlet of the first supply duct to the first ice maker in order to direct the chilled air from the evaporator to the first ice maker;

a second supply duct having an inlet positioned for receiving the chilled air from the evaporator, the second supply duct extending from the inlet of the second supply duct to the second ice maker in order to direct the chilled air from the evaporator to the second ice maker;

a first return duct that extends from the first ice maker to about the evaporator; and a second return duct that extends from the second ice maker to about the evaporator.

2. The ice making appliance of claim 1, further comprising an air handler operable to urge the chilled air from the evaporator into the first and second supply ducts.

3. The ice making appliance of claim 2, further comprising a damper, the damper selectively adjustable between a first position, a second position and a third position, the damper obstructing the first supply duct in the first position, the damper obstructing the second supply duct in the second position, the damper obstructing neither the first supply duct nor the second supply duct in the third position.

4. The ice making appliance of claim 1, further comprising a first storage bin and a second storage bin disposed within the cabinet, the first storage bin positioned for receiving ice from the first ice maker, the second storage bin positioned for receiving ice from the second ice maker.

5. The ice making appliance of claim 1, further comprising an open topped evaporation pan positioned at a bottom portion of the cabinet, a drain conduit and a storage bin disposed within the cabinet, the storage bin positioned for receiving ice from the first ice maker, the drain conduit extending between the storage bin and the open topped evaporation pan.

6. The ice making appliance of claim 5, wherein the sealed system further comprises a condenser, the condenser of the sealed system positioned directly above the open top evaporation pan sized.

7. The ice making appliance of claim 5, wherein the ice making appliance is not plumbed to an external drain line.

8. The ice making appliance of claim 5, further comprising a drain line extending from said evaporation pan to an external drain.

9. The ice making appliance of claim 1, wherein the first ice maker is a clear cube-style ice maker and the second ice maker is a nugget-style ice maker.

10. An ice making appliance, comprising:

a cabinet;

means for producing a first type of ice with chilled air;

means for producing a second type of ice with chilled air, the first and second types of ice being different;

a sealed system comprising an evaporator, the evaporator configured for generating the chilled air during operation of the sealed system;

an open topped evaporation pan positioned at a bottom portion of the cabinet;

a storage bin disposed within the cabinet, the storage bin positioned for receiving ice from the first ice maker, the drain conduit extending between the storage bin and the open topped evaporation pan, wherein the sealed system further comprises a condenser, the condenser of the sealed system positioned directly above the open top evaporation pan.

11. The ice making appliance of claim 10, further comprising an air handler operable to circulate the chilled air.

12. The ice making appliance of claim 10, wherein the ice making appliance is not plumbed to an external drain line.

13. A method for operating an ice making appliance, comprising:

generating chilled air at an evaporator of a sealed system of the ice making appliance;

directing the chilled air from the evaporator to a first ice maker of the ice making appliance and a second ice maker of the ice making appliance;

forming a first type of ice in the first ice maker and a second type of ice in the second ice maker during said step of directing, the first and second types of ice being different; and storing the first type of ice in a first storage bin of the ice making appliance and the second type of ice in a second storage bin of the ice making appliance;

establishing whether the first or second storage bins are full of ice; and actuating a damper of the ice making appliance to a first position of the first storage bin is full at said step of establishing or to a second position if the second ice storage bin is full at said step of establishing.

14. The method of claim 13, wherein a temperature of the first ice maker and a temperature of the second ice maker are less than a freezing temperature of water during said step of forming.

15. The method of claim 13, wherein ice within the first and second storage bins melts during said step of storing, the method further comprising directing melt water from the first and second storage bins to an evaporation pan of the ice making appliance and evaporating liquid water within the evaporation pan.

* * * * *